US005086250A

United States Patent [19]

Van Der Waal

[11] Patent Number: 5,086,250

[45] Date of Patent: Feb. 4, 1992

[54] COLOR CATHODE RAY TUBE HAVING SHADOW MASK WITH SOME LONG, NARROW APERTURES

[75] Inventor: Jan Van Der Waal, Eindhoven, Netherlands

[73] Assignee: U.S. Philips Corporation, New York, N.Y.

[21] Appl. No.: 172,877

[22] Filed: Mar. 25, 1988

[30] Foreign Application Priority Data

Apr. 10, 1987 [GB] United Kingdom ..... 8708574

[51] Int. Cl.[5] ..... H01J 29/81

[52] U.S. Cl. ..... 313/403; 313/408

[58] Field of Search ..... 313/402, 403, 408

[56] References Cited

U.S. PATENT DOCUMENTS 3,652,895 3/1972 Tsuneta et al. ..... 313/403

4,300,070 11/1981 Godfrey et al. ..... 313/403

FOREIGN PATENT DOCUMENTS 0128549 10/1981 Japan ..... 313/403

*Primary Examiner*—Donald J. Yusko

*Assistant Examiner*—Michael Horabik

*Attorney, Agent, or Firm*—John C. Fox

[57] ABSTRACT

A color cathode ray tube having a shadow mask comprising columns of vertically elongate apertures separated by bridges. In order to obtain smooth north and south edges to the cathodoluminescent screen and the desired mask transmission, at least some of the apertures which terminate at the top and bottom mask edges are longer and narrower than the adjacent apertures in the same column. These longer, narrower apertures are provided in those cases where normal width apertures would have been excessively foreshortened by the mask edge, for example their lengths are less than their widths, and where columns would have terminated in a bridge or a part thereof.

5 Claims, 2 Drawing Sheets

COLOR CATHODE RAY TUBE HAVING SHADOW MASK WITH SOME LONG, NARROW APERTURES

BACKGROUND OF THE INVENTION

The present invention relates to a colour cathode ray tube of the shadow mask type.

The cathodoluminescent screens of such cathode ray tubes frequently comprise triplets of vertically extending stripes of phosphors which luminesce in different colours. The shadow mask is a metal sheet having columns of elongate apertures, contiguous apertures in each column being separated heightwise by a bridge. Also the apertures in adjacent columns are staggered by half the vertical pitch of the apertures at the central portion of the shadow mask. This staggering of the columns of apertures reduces moiré effects in the image as viewed and also provides the mask with a greater rigidity than would be the case if the columns were not staggered. However when making the cathodoluminescent screen by a photographic process, such as that disclosed in British Patent Specification 1501549 the shadow mask is used as a master through which light is projected to expose photoresist applied to the faceplate. As the top and bottom edges of the mask hole pattern are curved, the border line will intersect some of the holes. In consequence the remaining parts of some apertures are so small that during screen manufacture there is either a very small phosphor dot or no phosphor dot on the screen. In the case of a column terminating in a bridge or part of a bridge then the phosphor stripe stops short of the nominal screen edge. Both these shortcomings manifest themselves in fairly rapid variations in the picture edge of the screen.

There have been many proposals for producing a smooth picture edges north (top) and south (bottom). One of these is European Patent Specification 0 001 673-A2 in which all the columns terminate in complete apertures having the same horizontal width as that of the nearby apertures in the same column. In order to ensure that all the columns terminate in complete apertures then (1) in those cases where a column would otherwise be terminated by a shorter than normal aperture, the short aperture is joined to the penultimate in the column by eliminating the bridge therebetween, and (2) in those cases where the column terminates in a bridge then the adjacent slot is lengthened by removal of the bridge material. Whilst such a proposal will produce a smooth edge it has the drawback that the mask transmission through these longer than normal apertures is somewhat larger than is intended and results in a sudden and unacceptable variation in brightness.

SUMMARY OF THE INVENTION

It is an object of the present invention to avoid producing such variations in brightness.

According to the present invention there is provided a colour cathode ray tube comprising an envelope including a faceplate, a cathodoluminescent screen provided on an internal surface of the faceplate, the screen comprising triplets of materials which luminesce in different colours, and a shadow mask disposed adjacent to, but spaced from, the screen, the shadow mask comprising a metal sheet having therein columns of elongate apertures separated by bridges, characterised in that the top and bottom edges of the mask are curvilinear and the apertures at the ends of the columns terminate at one or other of said edges, and characterised in that at least some of the apertures terminating at said top and bottom edges are narrower than, and longer than, adjacent apertures in the same column.

The present invention is based on the concept that the lengths of the apertures which terminate at the top and bottom edges should exceed a certain minimum value dependent for example on the width(s) of the apertures to ensure that the phosphor materials are applied to the screen but in those cases where the cross-sectional area the aperture would otherwise exceed that of an adjacent aperture in the same column then the width of the aperture is less than that of the adjacent aperture in order to reduce the mask transmission.

Japanese Kokai 56-128549(A) discloses a slotted shadow mask in which in the etched, but undrawn, flat mask sheet some of the apertures terminating at the edge are narrower and longer than the centrally disposed apertures. However it is intended that these narrower apertures deform laterally during the deep drawing of the mask sheet to its final protrusive shape so that their width increases to a value close to that of the adjacently disposed apertures in the same column. Accordingly such a finished mask will exhibit an undesired increased mask transmission at the north and south edges. Additionally in order to achieve such a lateral deformation of the narrowed apertures the mask has to be designed so that the apertures will deform under an applied lateral, that is east-west, force.

In forming the mask sheet used in the cathode ray tube made in accordance with the present invention either an all-sided drawing process is used so that the forces are substantially radial without having a predominant lateral component or a uni-lateral drawing process is used in which the forces are applied lengthwise (north and south) and not laterally (east and west). Additionally the bridges are designed to withstand deformation of the apertures due to lateral components of the applied forces.

In an embodiment of the present invention others of the apertures terminating at the top and bottom edges each have substantially the same width as the horizontal width of, and a length less than that of, the adjacent aperture in the same column. Generally speaking the lengths of these others of the apertures will exceed their respective widths.

BRIEF DESCRIPTION OF THE DRAWINGS

The present invention will now be explained and described, by way of example, with reference to the accompanying drawings, in which.

In the drawings the same reference numerals have been used to illustrate corresponding features.

DESCRIPTION OF THE PREFERRED EMBODIMENTS

Figure 1:
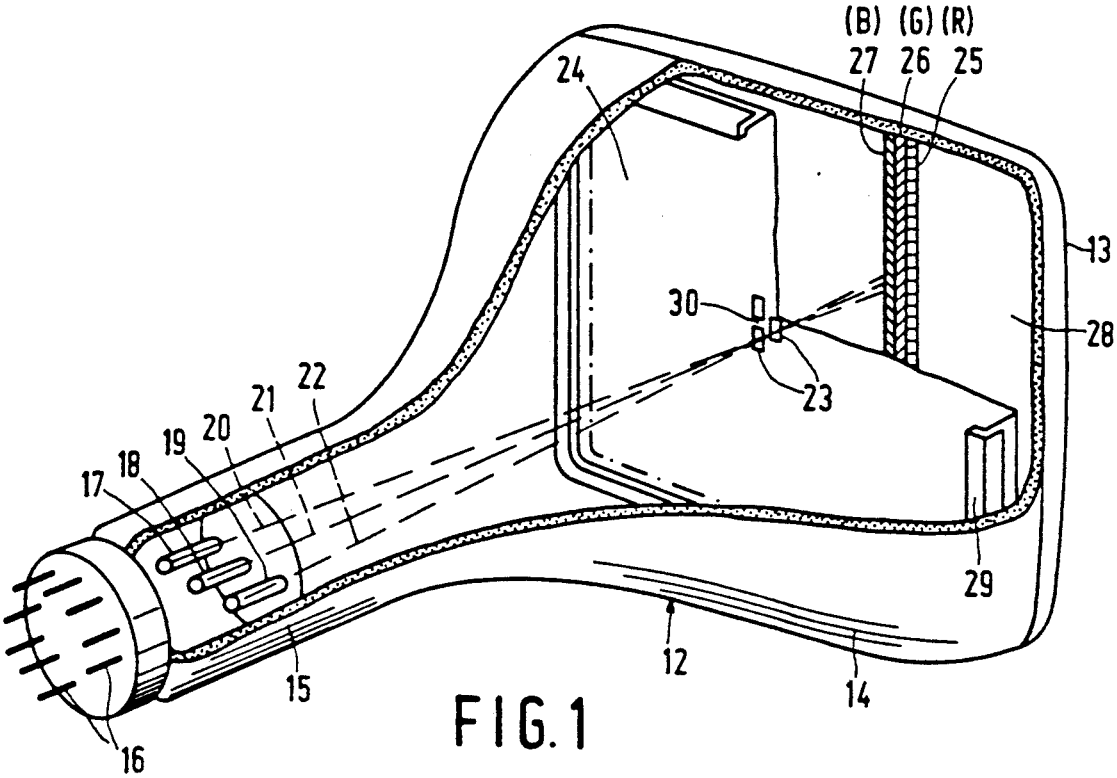
FIG. 1 is a perspective view, partly broken away, of a colour cathode ray tube made in accordance with the present invention.

The colour cathode ray tube shown in FIG. 1 comprises a glass envelope 12 which is composed of a display window 13, a cone 14 and a neck 15 having contact pins 16. Three electron guns 17, 18 and 19 are situated in the neck 15. The axes of these guns are situated in one horizontal plane and the outermost guns enclose a small angle with the central gun, so that the generated electron beams 20, 21 and 22 pass through apertures 23 in a colour selection electrode or shadow mask 24 at an angle and thus each impinge on phosphor lines 25, 26 and 27, respectively, to form a coherent multi-coloured image. The whole display screen 28 consists of such triplets of phosphor lines of which one is shown. Phosphor line 25 is a phosphor luminescing red (R), phosphor line 26 is a phosphor luminescing green (G) and phosphor line 27 is a phosphor luminescing blue (B). The shadow mask 24 consists of a metal plate having a very large number of columns of apertures 23 extending in the direction of the phosphor lines, which plate is secured in a metal ring 29 which is mounted in the display tube in front of the display screen 28. Successive apertures in a column are separated by bridges 30 (sometimes known as dams). The apertures 23 in each column are staggered relative to the apertures in an adjacent column in order to make the shadow mask more rigid and to avoid moiré effects in the image as viewed on the screen 28. As will be described in the following text the apertures at the ends of some of the columns are of different shapes compared to their neighbours in order to be able to obtain smooth north and south picture edges and an even mask transmission at the edges of the shadow mask.

Figure 2:
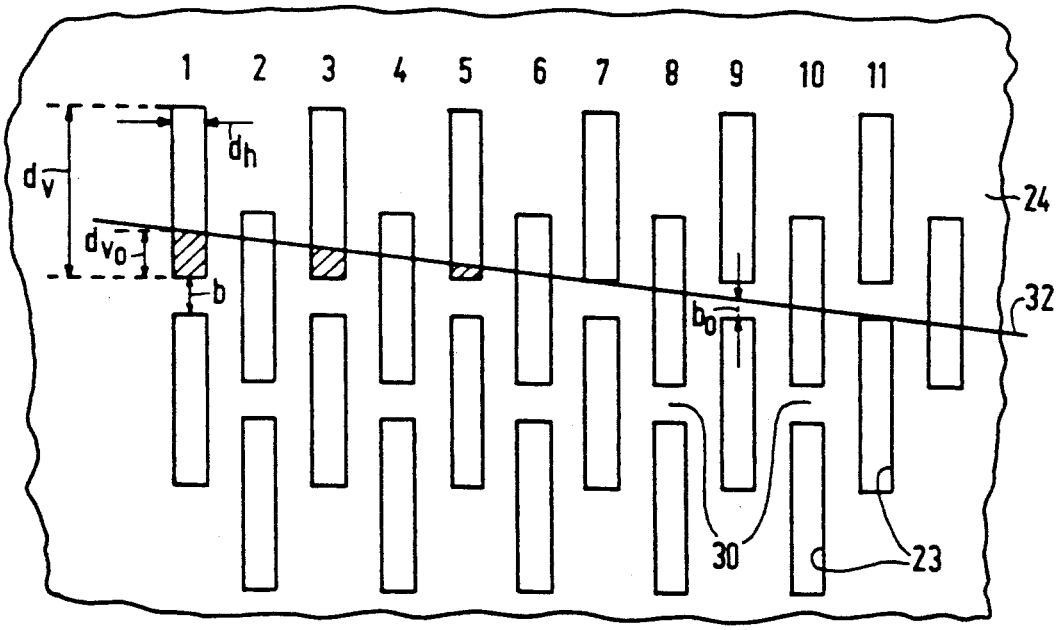
FIG. 2 PRIOR ART
FIG. 2 is a diagram illustrating the north-east corner of a shadow mask for use in which the apertures are all of the same shape and size.

In order to facilitate an understanding of the present invention reference is made to FIG. 2. This drawing shows the north-east corner of an etched mask sheet 24 of the prior art. The apertures 23 in each column are all of the same vertical height $d_v$ and horizontal width $d_h$ and the vertical height of each bridge 30 is b. For convenience of description the columns have been referenced 1 to 11. The edge of the picture on the screen is denoted by the inclined line 32. An examination of FIG. 2 shows that the line 32 intercepts the apertures 23 and the bridges 30 to a varying extent. Everything above the line 32 can be ignored so that the length of the foreshortened slot is denoted by $d_{Vo}$ and that of foreshortened bridge by $b_o$.

When producing a screen photographically by three exposures of respectively applied photoresist layers through the shadow mask, for example by the method disclosed in British Patent Specification 1501549, sometimes the value of $d_{Vo}$ may be so small that there is a risk of phosphors being absent on the screen or the area of the phosphor is so small that it may be ineffective—see for example columns 1, 3 and 5. This results in a serrated edge to the screen. Columns 7 and 9 illustrate that the edge denoted by the line 32 terminates in a bridge and part of a bridge, respectively. This also results in a serrated edge on the shadow mask and the screen.

Figure 3:
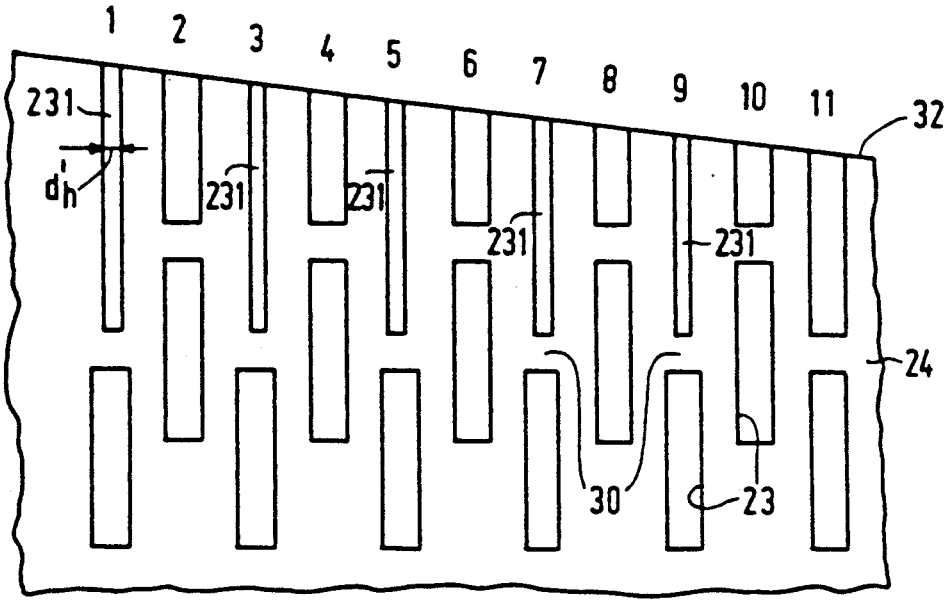
FIG. 3 is a diagram illustrating the north-east corner of a shadow mask for use in a colour cathode ray tube made in accordance with the present invention.

In the shadow mask used in the cathode ray tube made in accordance with the present invention those columns of apertures 23 which would give rise to a serrated edge to the north and/or south edge are modified as will be described with reference to and as shown in FIG. 3. In FIG. 3 those apertures which terminate in (1) too lower value for $d_{Vo}$, (2) a full size bridge or (3) a part of a bridge having a vertical height $h_o$, are combined with the neighbouring aperture in the same column and in order to avoid sudden variations in brightness, the width $d'_h$ of these apertures, referenced 231, is reduced to equalise the mask transmission with the adjacent areas. The widths $d'_h$ of the apertures 231 in those cases where the values of $d_{Vo}$ are too low, for examples columns 1, 3 and 5 in FIG. 2, can be calculated as follows:

$$d'_h = \frac{1}{1 + \left(\frac{b}{d_V + d_{Vo}}\right)} \cdot d_h \qquad (1)$$

This equation (1) can be modified when a column of apertures terminates with a bridge or part of a bridge, for example columns 7 and 9 in FIG. 2, so that $$d'_h = \frac{1}{1 + \left(\frac{b_o}{d_V}\right)} \cdot d_h \qquad (2)$$

With respect to column 7 $b_o = b$. A numerical example of equation (2) is as follows: Assume $b = b_o = 0.110$ mm, $d_V = 0.660$ mm and $d_h = 0.150$ mm, then $d'_h$ is 0.129 mm so that the aperture is 0.021 mm narrower than the adjacent aperture in the same column. Such a small difference will have hardly any undesired consequences but will provide a desired local mask transmission.

The decision on which of the foreshortened apertures 23 in FIG. 2 should be combined with an adjacent aperture in the same column and the area of the newly created aperture adjusted to equalise the mask transmission can be done empirically but as a general guide if the length $d_{Vo}$ of a foreshortened aperture is equal to or less than the nominal width $d_h$ then it should be combined with the next aperture in the same column. However when implementing the method disclosed it should be remembered that the criteria to be fulfilled when modifying the mask apertures are (1) obtaining smooth north and south picture edges and (2) obtaining the desired mask transmission for that area of the mask.

Figure 4:
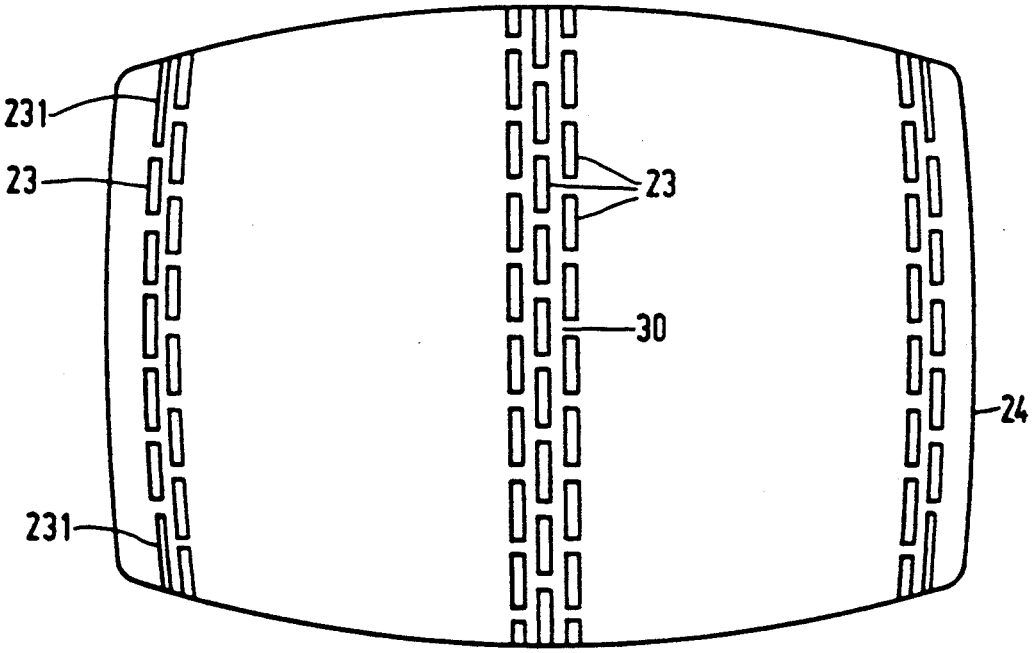
FIG. 4 is a diagrammatic elevational view of a shadow mask (not to scale) suitable for use in a cathode ray tube made in accordance with the present invention.

FIG. 4 illustrate a shadow mask 24 suitable for use in a colour cathode ray tube made in accordance with the present invention. The length and vertical pitch of the unmodified apertures 23 is substantially the same over the entire area of the screen but the widths of the apertures 23 may be graduated, for example wider at the centre than at the east-west edges, in order to obtain a desired overall mask transmission. The centrally located columns of apertures 23 are substantially straight at the centre but are curved outwards at the edges. The bridges 30 are designed to resist deformation of the apertures 23 and 231 when the mask sheet is deep drawn to form it into its final protrusive shape. The forming operation is a deep drawing one in which either all four sides of the mask sheet are clamped in a press so that when the two parts of the forming die are closed the forces on the mask sheet are substantially radial, or the north and south sides of the mask sheet are clamped in a press and the forces act substantially vertically as viewed in FIG. 4 so that there are little or no lateral components.

What is claimed is:

1. A colour cathode ray tube comprising an envelope including a faceplate, a cathodoluminescent screen provided on an internal surface of the faceplate, the screen comprising triplets of materials which luminesce in different colours, and a shadow mask disposed adjacent to, but spaced from the screen, the shadow mask comprising a metal sheet having therein columns of elongate apertures separated by bridges, wherein the top and bottom edges of the mask are curvilinear and the apertures at the ends of the columns terminate at one or other of said edges, and characterised in that at least some of the apertures terminating at said top and bottom edges are narrower than, and longer than, adjacent apertures in the same column and others of said apertures terminating at said top and bottom edges each have substantially the same width as the horizontal width of, and a length less than that of, the adjacent aperture in the same column.

2. A cathode ray tube as claimed in claim 1, in which the length of each of the others of said apertures is greater than its horizontal width.

3. A cathode ray tube as claimed in claim 1, in which the respective horizontal width ($d'_h$) of some of said narrower apertures is equal to $$d'_h = \frac{1}{1 + \left(\frac{b}{d_V + d_{Vo}}\right)} \cdot d_h \qquad (1)$$

where $d_h$ is the horizontal width of an adjacent aperture in the same column, b is the vertical height of a bridge, $d_V$ is the length of said adjacent aperture and $d_{Vo}$ is the length of an imaginary aperture having the same horizontal width as said adjacent aperture but which has been foreshortened by the mask edge, the imaginary aperture having as its neighbour another imaginary aperture of the same length as said adjacent aperture in the same column.

4. A cathode ray tube as claimed in claim 1, in which the respective horizontal width ($d'_h$) of some of said narrower apertures is equal to $$d'_h = \frac{1}{1 + \left(\frac{b_o}{d_V}\right)} \cdot d_h \qquad (2)$$

where $d_h$ is the width of an adjacent aperture in the same column, $d_V$ is the length of said adjacent aperture and $b_o$ is the vertical height of an imaginary bridge which is at, or has been foreshortened by, the mask edge, said imaginary bridge being adjacent an imaginary aperture of the same length as said adjacent aperture in the same column.

5. A cathode ray tube as claimed in claim 1, in which the vertical pitch of the apertures in the shadow mask is substantially constant over its entire area.

* * * * *